US006530169B1

(12) United States Patent
Griffin

(10) Patent No.: US 6,530,169 B1
(45) Date of Patent: Mar. 11, 2003

(54) TOGGLE ACTION SEE THROUGH SHOTGUN SHELL CATCHER

(76) Inventor: Frederick M. Griffin, 4131 Paseo De Las Tortugas, Torrance, CA (US) 90505

( * ) Notice: Subject to any disclaimer, the term of this patent is extended or adjusted under 35 U.S.C. 154(b) by 0 days.

(21) Appl. No.: 09/602,760

(22) Filed: Jun. 23, 2000

(51) Int. Cl.[7] ..... F41A 15/00; F41A 15/12
(52) U.S. Cl. ..... 42/98; 89/33.4
(58) Field of Search ..... 42/98; 89/33.4

(56) References Cited

U.S. PATENT DOCUMENTS 1,201,189 A * 10/1916 Johnson ..... 224/0.5
1,304,468 A * 5/1919 Fernandez ..... 244/0.5
3,739,685 A * 6/1973 Lundgren ..... 42/98
3,807,075 A * 4/1974 Mylonas ..... 42/98
4,028,834 A * 6/1977 Dobson ..... 42/98
4,166,333 A * 9/1979 Kratzer ..... 42/98
4,594,803 A * 6/1986 Muncy ..... 42/98
4,715,141 A * 12/1987 Kohnke ..... 42/98
4,903,426 A * 2/1990 Bammate ..... 42/98
4,959,918 A * 10/1990 Perez ..... 42/98
5,285,593 A * 2/1994 Bammate ..... 42/98
5,398,439 A * 3/1995 Harless ..... 42/98
5,811,716 A * 9/1998 Ellzey ..... 89/33.4
6,173,520 B1 * 1/2001 Bucciarelli et al. ..... 42/98

* cited by examiner

*Primary Examiner*—Charles T. Jordan
*Assistant Examiner*—John W. Zerr
(74) *Attorney, Agent, or Firm*—Michael McEntee

(57) ABSTRACT

This invention is an improved shotgun shell catcher. It has a cage of very light weight construction, which captures many casings before it must be emptied. Toggle action permits near effortless operation to quickly unload the empty casings. Thumbwheel locking means permits near effortless attachment and removal of the device from the side of a shotgun.

3 Claims, 6 Drawing Sheets

Fig. 6
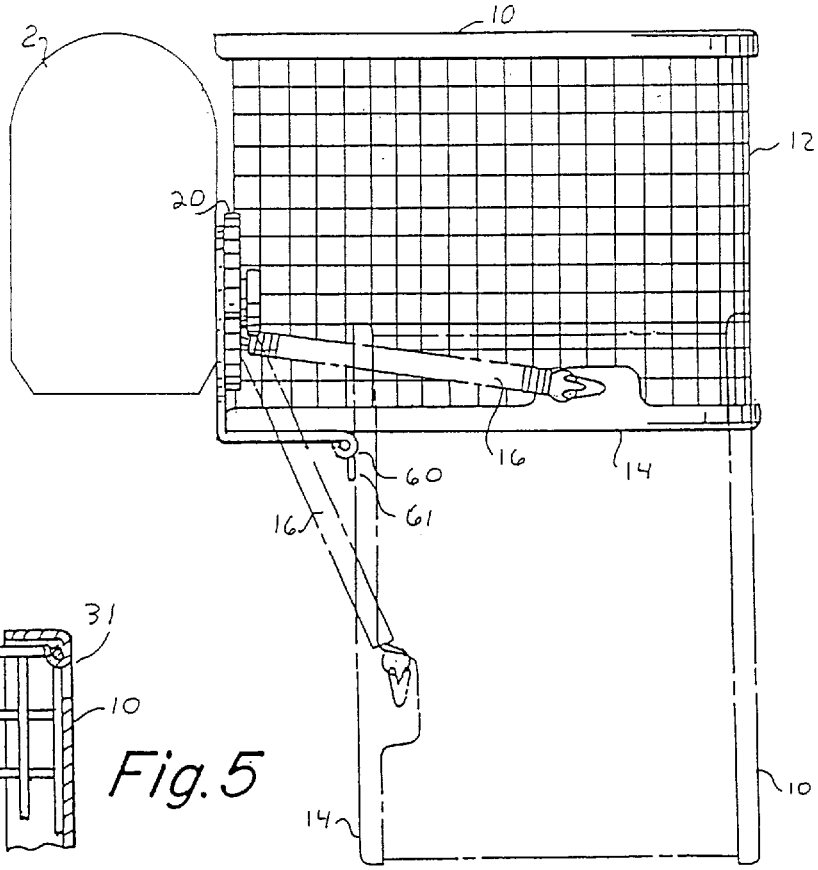
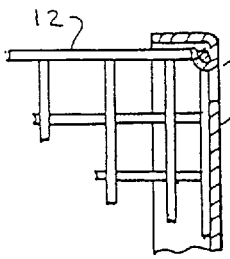
Fig. 5
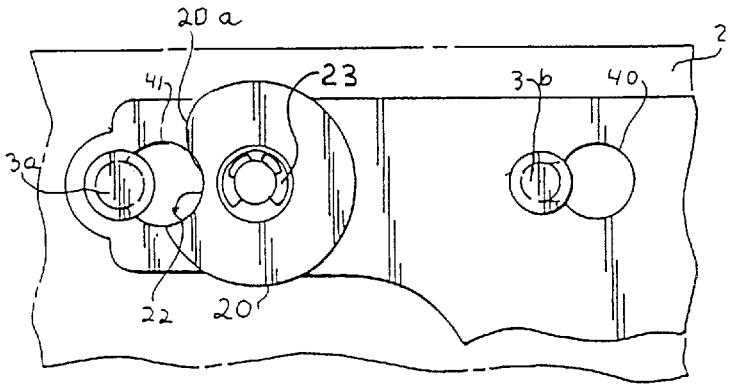
Fig. 7
Fig. 8
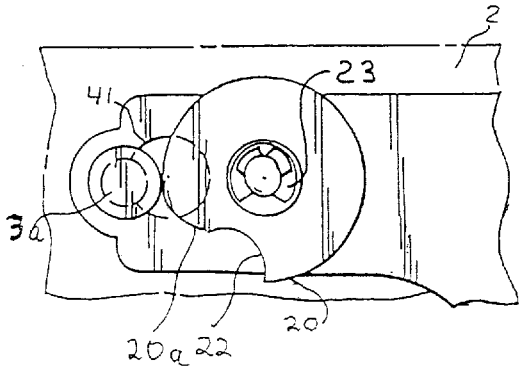

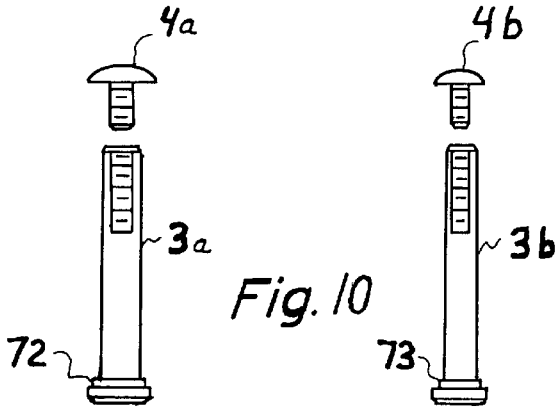
Fig. 10
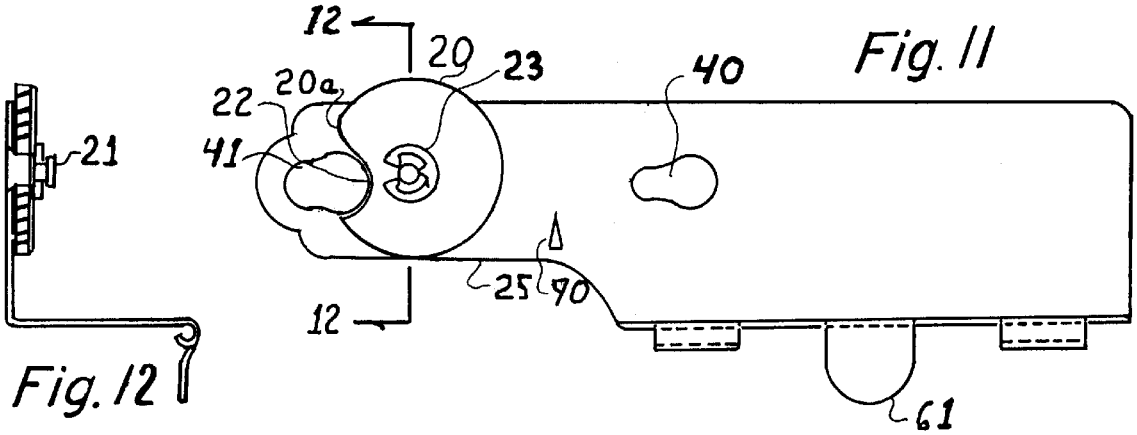
Fig. 11
Fig. 12
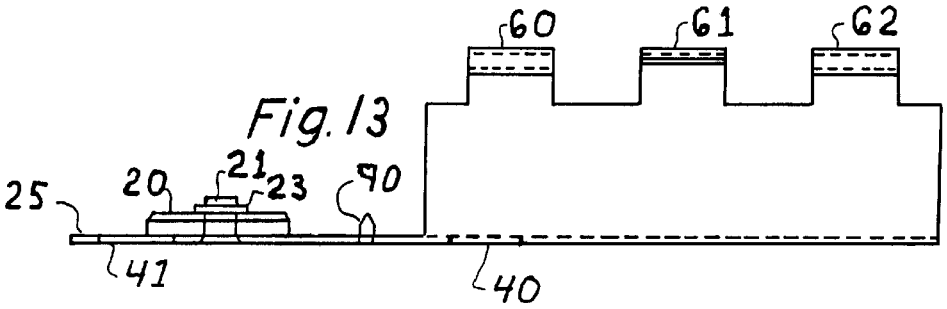
Fig. 13

TOGGLE ACTION SEE THROUGH SHOTGUN SHELL CATCHER

BACKGROUND-FIELD OF THE INVENTION

The present invention relates to catching spent shell casings upon their ejection from the side of shotguns and rifles.

BACKGROUND-DESCRIPTION OF THE PRIOR ART

Throughout this discussion, I assume a right handed sportsman, i.e. a sportsman squeezing the trigger of his or her shotgun with his or her right trigger finger, and I assume that a shotgun ejects its used shell casing to the right side of the shotgun, The shell casing catcher is then arranged to be mounted on the right side of the shotgun.

The problems which a left handed sportsman has in using a rifle or shotgun were described in U.S. Pat. No. 5,138,787, issued August, 1992, to Ronald and Travis Riddle. That patent shows a device for catching and holding rifle shell casings ejected from a conventional M16 or similar rifle. It utilizes a rigid metal shell deflector and a flexible bag below the shell deflector. At column 1, lines 28–38, the problem of a left handed rifleman being burned by hot shell casings being ejected from the right hand side of a rifle is described and utilized as one reason to adopt the device showing in Riddle '787. FIG. 3 of that patent shows the deflector 32 and bag 26, mounted on the right hand side of the M16 rifle.

U.S. Pat. No. 4,959,918 issued October 1990 to Kenneth Perez described a shell catcher for handheld firearms which can be detachably mounted adjacent a chamber of the firearm from which the used shells are expelled. The device provides for the use of a flexible bag carried by a rigid frame and a mounting bracket which allows the device to be mounted on the gun without scratching its surface. Like Riddle '787, Perez '918 provides for a shell deflector. Shell casings are then extracted from the bag by opening a zipper 58 as shown in FIG. 3. At col. 1, lines 10–20, Perez mentions protecting the environment, and hunters spending hours searching for the empty shells and retrieving them.

U.S. Pat. No. 3,153,981 issued October 1964 to William Brass describes a receiver for spent shell casings. That patent shows a flexible bag which is stretched over a spring steel wire frame and clamped to the side of a rifle. Between the wire frame and the clamp is a pivot, described at col. 3, lines 30–50. The pivot action is restrained by friction imposed on the pivot by the spring steel wire frame. At col. 3, lines 50–55, Brass mentions, "It will be noted that the device is relatively light, and thus will not impair the balance of the firearm. The device is easily mounted in place, and removed, and when mounted in place remains firmly in position. No modification of the firearm is needed to mount the device in place."

The above patents are representative of the "bag catcher" approach to catching spent shell casings. The advantages and disadvantages of the "bag approach" are described in the Summary of Invention, below. The other approach to solving the problem is the "shell retainer" approach. Three representatives examples of that prior art are given here.

U.S. Pat. No. 3,603,015 issued September 1971 to Kenneth W. Jensen describes a metal a "keeper rod" slidably supported on the gun substantially parallel to the barrel, and disposed adjacent the discharge port. In the operative position, the keeper rod holds the empty shell casing in the ejection port where it can be manually removed after a single firing. In a nonoperative position, the keeper rod allows the ejected shell casings to leave the discharge port so that the magazine can be fully loaded to permit multiple firing.

U.S. Pat. No. 3,609,900 issued October 1971 to William Bernocco describes a clip which attaches adjacent to the ejection port of a rifle and grips a shell casing upon ejection.

A device similar in effect to Jensen, '015 and Bernocco '900 is described in "Skeet Shooting Review" May 1995, at page 75. The device is labelled "The Morton Mechanical Shell Catcher." The advertisement includes the phrases, "U.S. Pat. No. 3,984,932," "For Remington Models 1100 & 11–87 Automatic Shotguns" and "Fits Both 12 Gauge (Right Hand Models Only) and 20 Gauge (Right Hand, Standard Weight Model Only)."

Another device similar in effect to Jensen, Bernocco, and Morton is shown in "Shooting Accessories Ltd" catalog dated "March 1995" On the back page of the catalog is the "T & S Shell Catcher (Snaps On and Off)." The picture in the catalog shows a plastic clip which appears to partially block the ejection port, such that the spent shell casings become wedged and fails to fully eject.

In essence, the Jensen, Bernocco, Morton and Shooting Accessories devices restrict the sportsman to one round before having to interrupt and reach up, remove the shell, and then resume shooting.

SUMMARY AND OBJECTS OF THE INVENTION

The present invention utilizes a "see through cage" which is mounted on an offset bracket which in turn is mounted adjacent to the ejection port. The cage is pivoted to rotate between two specific positions 90 degrees apart. An extension spring extends between a particular position on an offset bracket and a particular position on the cage. As a result, the cage can toggle and hold firmly in either a shell casing receiving position or in an unload position.

In the shell casing receiving position, the mouth of the cage toggles up close to the ejection port.

Unlike the prior art, there is no clamp to squeeze the offset bracket against the body of the shotgun. Instead, keyholes formed in the bracket slide onto two threaded step pins, and the bracket is locked in place by the interaction of a detent 22 and a cam surface 20*a* formed in a thumbwheel 20 and mounted for rotation parallel to the offset bracket 25. The cam surface 20*a* allows a fast and reliable way to ruggedly attach the shell catcher bracket to step pins on the firearm.

The step pins replace pins which are normally part of the firearm, and which lock in place the trigger mechanism and action of the shotgun. For example, the Remington semi-automatic shotgun, model 1100, has pins which can quickly and easily be removed and replaced with the two threaded step pins.

It is a primary object of the present invention to minimize distraction and loss of accuracy while the sportsman is aiming and shooting. The prior art has five main drawbacks which serve as sources of distraction for the sportsman:

1. Breaking the pattern and timing of the sportsman by requiring him to reach up and remove the shell casing from the shell casing retainer, such as in Jensen and Morton devices described above.
2. Interfering with the "sight" of the sportsman, i.e. the view adjacent to the long axis of the shotgun barrel. That "sight" includes a target, the lead ahead of the target, and the firearm. For example Riddle '787, and Perez '918 block part of the "sight." By contrast, the present invention permits the sportsman to look right through the mesh walls.

3. Interfering with the static "balance" of the firearm resulting in torque which pulls the rifle to the right while the firearm is being raised and aimed.
4. Interfering with the Dynamic "balance of the firearm.
5. Causing noise or rattling which distracts the shooter.

It is a further object of the invention to control the trajectory of the expended shell casings such that they do not wedge against the walls of the cage and instead, lay down in parallel with each other inside the cage.

BRIEF DESCRIPTION OF THE DRAWINGS

These and other objects and advantages of the invention will be apparent from reading the following description in conjunction with the drawings.

FIG. 5 is a cross section taken through FIG. 4.

FIG. 6 is a rear elevation view, showing what is seen as one uses the shotgun. It shows the alternate position of the see through cage used to empty the cage of spent shotgun casings.

FIG. 7 is a close up of the locking mechanism between the invention and the shotgun.

FIG. 8 shows the alternate position of the view in FIG. 7.

FIG. 10 is an axial pictorial view of the two step pins and the trusshead screws used to secure the step pins into the shotgun.

FIG. 11 is a side view of the bracket 25 as it is seen facing the right side of the shotgun. The shotgun is not shown in FIG. 11.

FIG. 12 is an end sectional view of the bracket 25 taken through FIG. 11. In particular, it shows rivet 21 is attached to bracket 25 and acts as an axle for thumbwheel 20 and "E" ring 23.

FIG. 13 is a top broken view of the bracket 25 shown in FIG. 11.

DESCRIPTION OF THE PREFERRED EMBODIMENT

Figure 1:
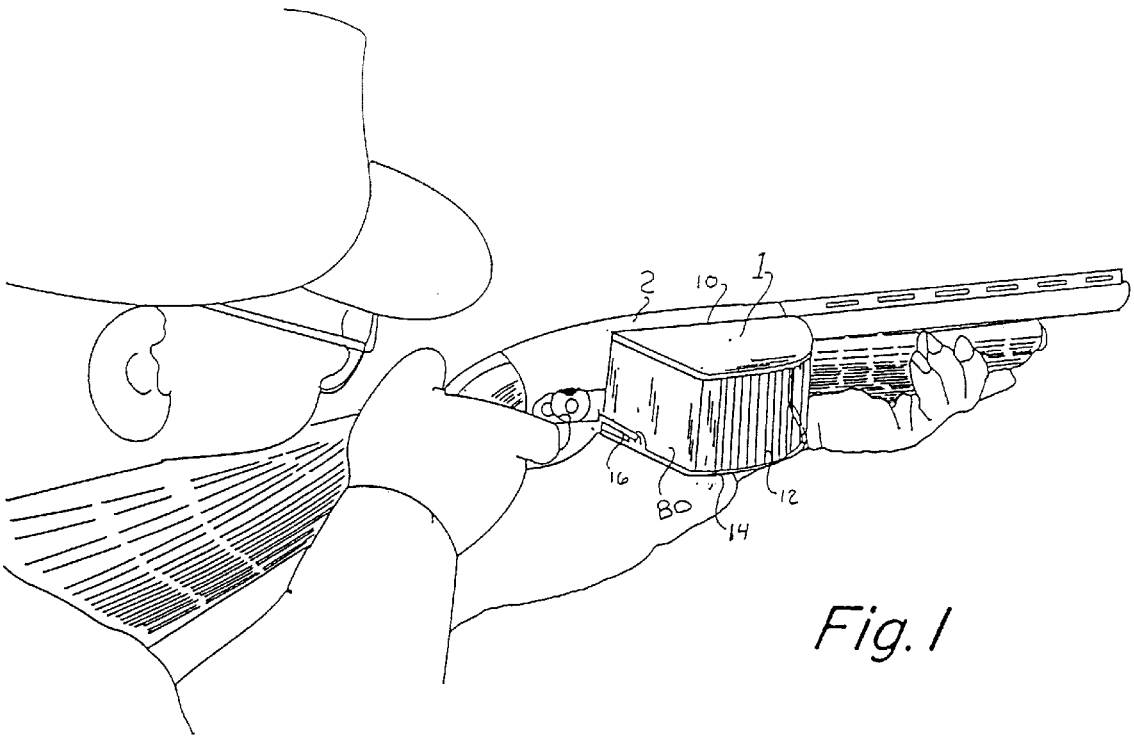
FIG. 1 is a pictorial elevation view of a shotgun and the invention attached to the right side of the shotgun.

Referring to FIG. 1, the sportsman is seen holding a shotgun 2. Attached to the right side of the shotgun is the shotgun shell catcher 1 which is the subject of this patent. The shotgun shell catcher 1 is attached to the side of the shotgun by engaging two step pins 3*a* and 3*b* which appear in FIGS. 4, 7, 8, and 10. Both step pins, 3*a* and 3*b,* are internally threaded to accept screws 4*a* and 4*b*.

Figure 2:
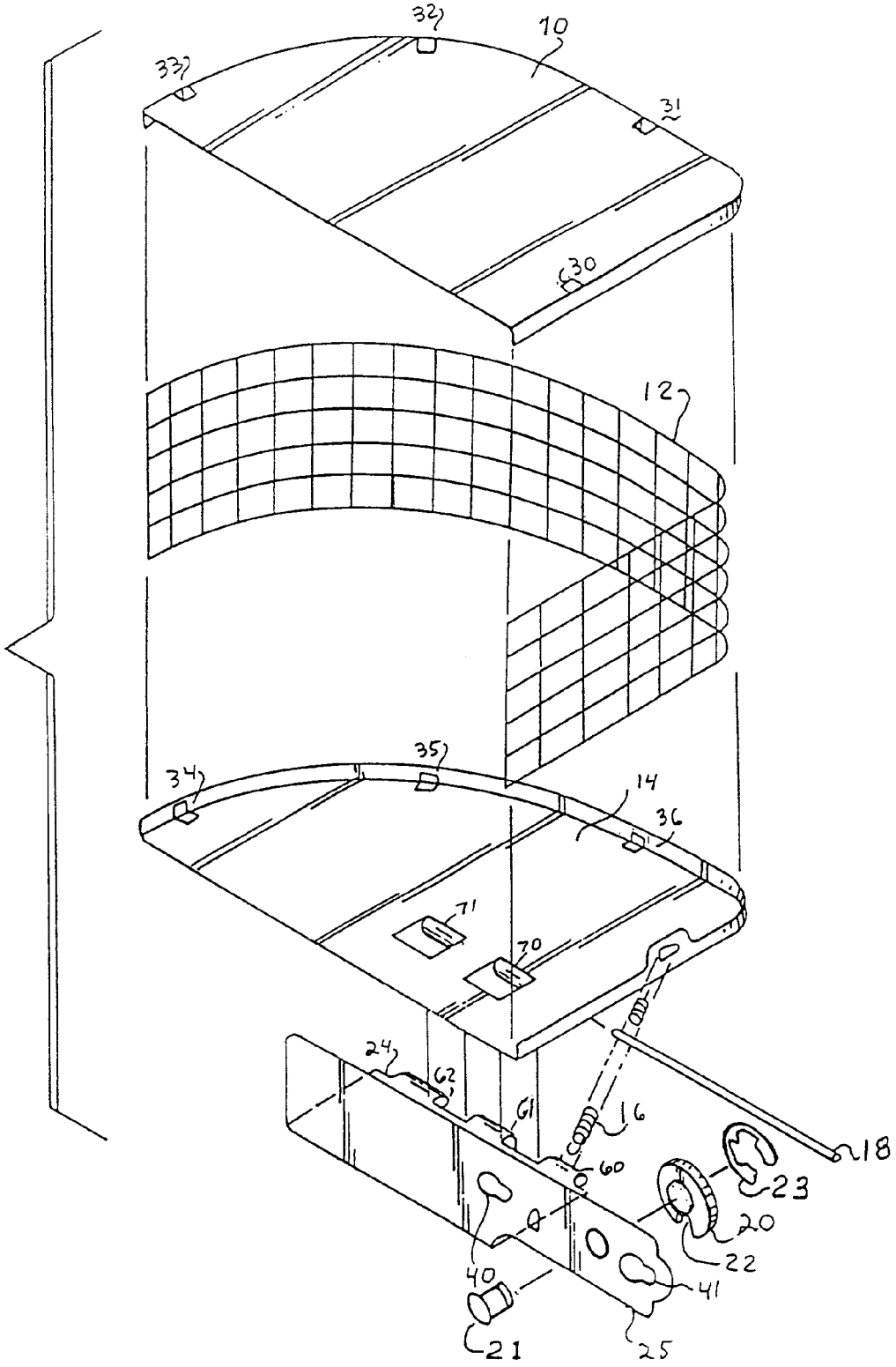
FIG. 2 is a perspective exploded view from the shotgun side, showing the major parts of the invention.

FIG. 2 is an exploded drawing. It shows the relationship of upper panel 10, wire cloth 12 and lower panel 14. This assembly forms a cage. The cage is biased by extension toggle spring 16. The assembly pivots on hinge pin 18. Knurled thumbwheel 20 is mounted for rotation on a rivet 21 attached (preferably by spotwelding) to bracket 25. The rivet functions as an axle on which the knurled thumbwheel cam 20 rotates. Another alternative (not shown), in lieu of spot welding, or in addition to welding, is to pierce the bracket web 25 with a hole and place therein a rivet or flat head bolt, around which rivet or bolt the knurled thumbwheel 20 may rotate. The knurled thumbwheel cam 20 can be secured to the shaft by either a spring clip, tinnerman nut, a nut, or cold heading the shaft. The ideal is a spring clip due to its predictable bias it may exert on the knurled locking cam.

Figure 3:
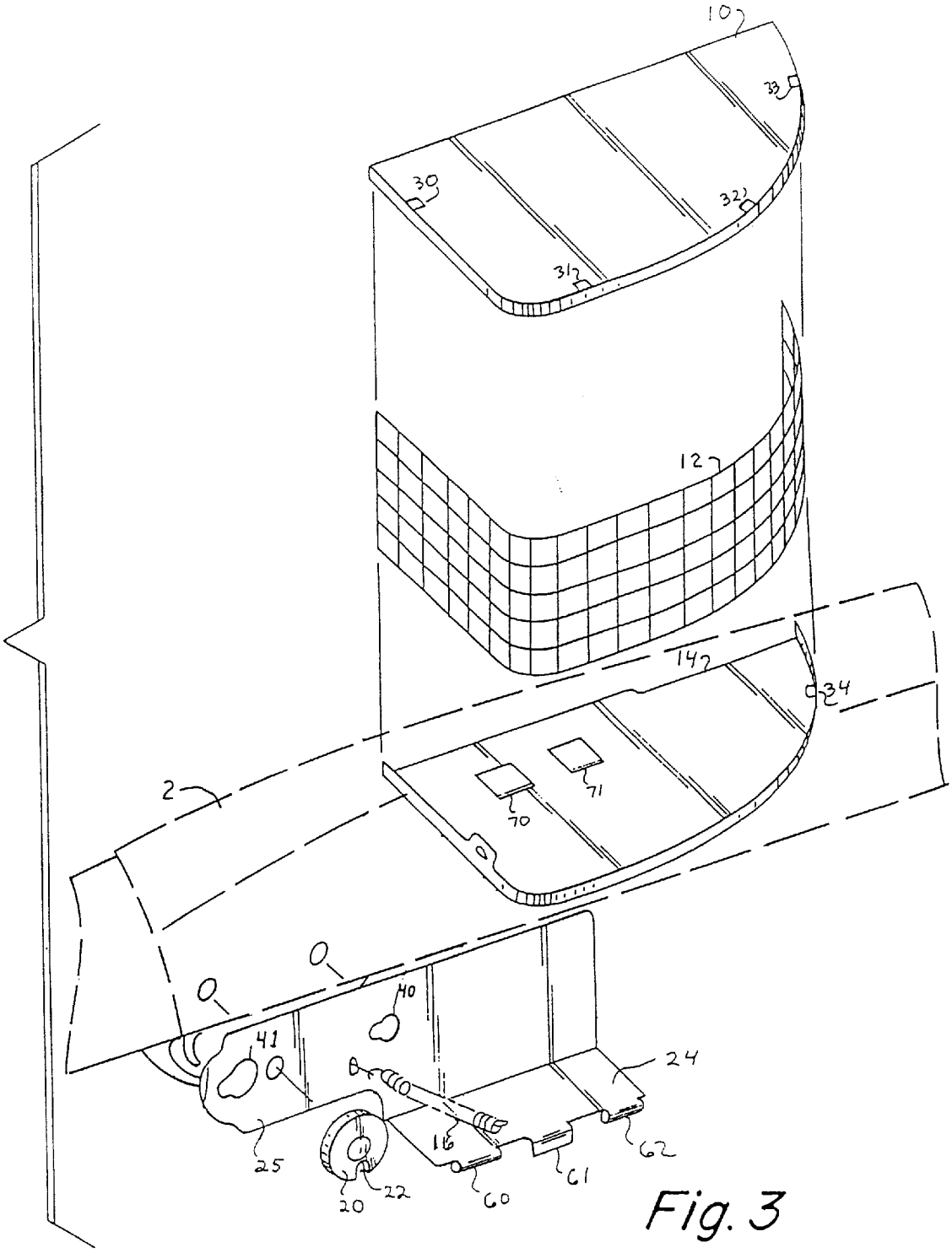
FIG. 3 is an exploded perspective view looking towards the shotgun.

FIG. 3 shows the detent 22 formed in the knurled thumbwheel 20 and keyholes 40 and 41 formed in bracket 25. Metal fingers 30, 31, 32, 33, 34, 35, 36, are formed by piercing and bending. They collectively provide the mechanical means by which the wire cloth 12 is firmly gripped to the upper panel 10 and the lower panel 14 to form the cage.

Hinge knuckles 60 and 62, (also know as tabs) are pierced from bracket flange 24. They grip axle 18. Hinge fingers 70 and 71 are pierced from lower panel 14. They also grip axle 18, thereby allowing the cage assembly to rotate about the axle. Stop tab 61 is blanked as part of bracket flange 24. When formed, it stops the rotation of the cage assembly at 90 degrees to the closed position. Thus the cage has two rest positions, the first has the cage pressing against the ejector port, and the second rest position is with the cage rotated open and part 14 pressing against stop tab 61. In the open position, the sportsman may easily retrieve and empty the shell casings from the cage.

Figure 4:
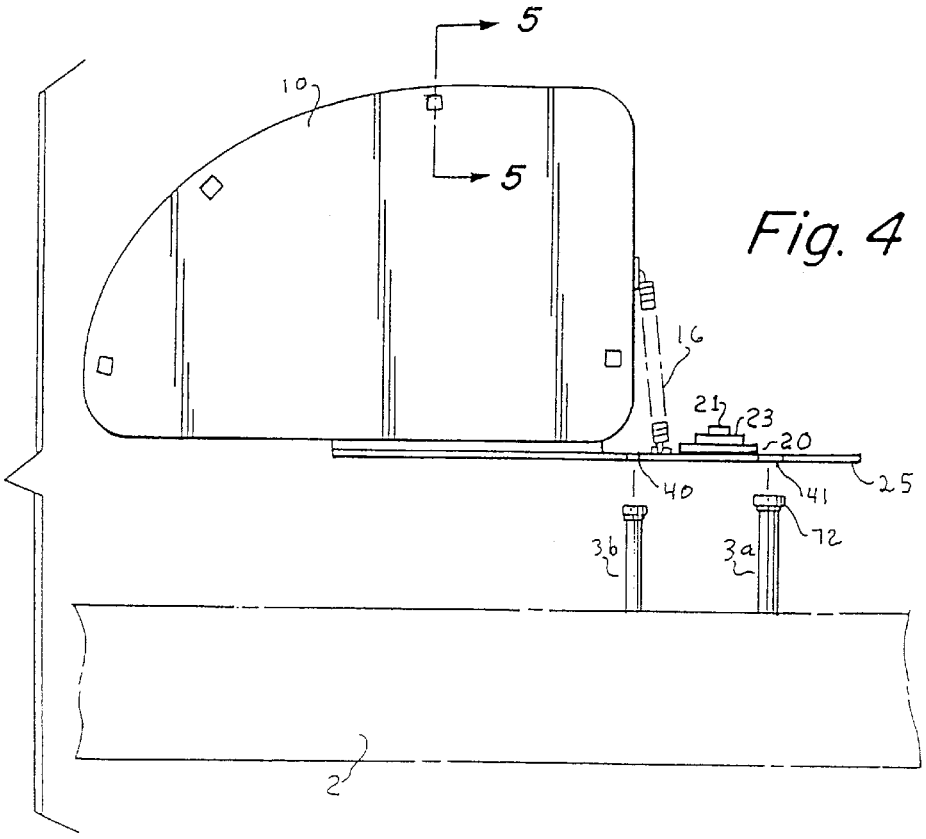
FIG. 4 is a top plan pictorial view showing the invention, step pins, and the location of the shotgun.

FIG. 4 shows step pins 3*a* and 3*b*. As their name suggests, the pins have a head. Shoulders, or "steps" space the head a predetermined distance from the body of the shotgun. This distance is just larger than the thickness of metal in the bracket web 25. Keyholes 40 and 41 in the flange wall interfit with those heads. When the knurled thumbwheel 20 is rotated to align detent 22 with the keyhole 41, the bracket 25 may be placed against the firearm 2 and the head 72 of step screw 3*a* passes through keyhole 41. Then, the sportsman may rotate the knurled thumbswheel 20 so that the detent 22 rotates and the cam surface 20*a* of the thumbwheel presses against screw head 72. This locks the bracket in place onto the firearm 2.

FIG. 5 shows a close up cross section of metal finger 31 wrapping around wire cloth 12 to provide a low cost, rapid assembly means of manufacturing.

FIG. 6 shows the orientation of the extension toggle spring 16. The word toggle is used to indicate that there are two alternative stable positions to which the assembly may move. One is in the closed position, wherein the cage presses up against the ejection port 50, and the other wherein the cage has rotated 90 degrees to the open position. In the open position, the shell casings may be recovered.

FIG. 7 shows the cam surface 20*a* on the thumbwheel 20, and keyhole 41, and step pin 3*a*. The thumbwheel can be knurled, smooth, or polygonal. In FIG. 7, the bracket is not yet locked in position because mounting detent 22 is shown aligned with step pin 3*a*. In that alignment, the two keyholes 40 and 41 in the bracket web 25 will just fit over the washer heads 72 and 73, of the step pins 3*a* and 3*b*. The bracket 25 then is slided to the right, and the washer heads interfit with the narrow portions of the keyholes. The thumbwheel 20 is rotated with thumb pressure, thereby rotating mounting detent 22 in a counter-clockwise direction, and thereafter cam surface 20*a* blocks sliding movement of the bracket web, assuring a tight, rugged connection between the invention and the shotgun.

FIG. 8 shows the cam in the locked position.

Figure 9:
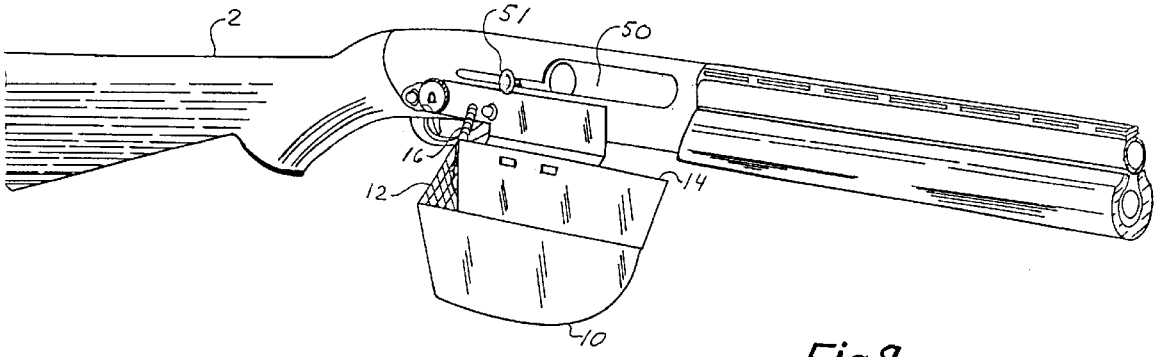
FIG. 9 is a perspective view from the front right of the shotgun. It shows the invention, and in particular, it shows the slide bolt on the shotgun, and how the cage fits around the action of that slide bolt.

FIG. 9 shows the location of the sliding bolt 51 on a typical Remington semi-automatic shotgun. One of the many important features of the invention is to permit easy movement of that bolt 51 during operation of the gun. The cage assembly allows the spent shell casings to eject, at considerable force, rattle around, and not block the action of the shotgun. Equally important, the cage allows additional spent shell casings to eject with no risk of clogging or jamming the shotgun.

FIG. 10 is a representative cross section of the truss head screws 4*a* and 4*b,* and the internally threaded step pins 3*a* and 3*b*. An additional feature of the invention is that the step pins are expected to be part of the product sold. Thus, they are part of the invention-whenever the manufacturer does not include them on the shotgun being sold.

FIGS. 11 and 13 shows that spring anchor 90 is blanked from the bracket 25. The location of spring anchor 90, and spring 16, with respect to the rest of the invention shown in FIGS. 9 and 6, give the invention the very desirable toggle action feature. FIGS. 11 and 13 also show the locking feature of the invention. In use, the knurled thumb cam 20 is rotated to align with keyhole 41, space is made for the head of step pin 3*a* to fit through keyhole 41. At the same time, the head of step pin 3*b* fits through keyhole 40. The user then pushes the bracket 25 forward to slide the keyholes 40 and 41 to interfit with shoulders 72 and 73. The sliding action is then locked in place by the user rotating with his or her thumb knurled thumb wheel 20. Cam surface 20*a* of the thumb wheel then acts as a cam to block sliding of the bracket 25. Equally important, the simple rotation of the thumb wheel back to the position shown in FIG. 11 will immediately, and without any tools, release the invention from its nested position on the shotgun.

FIG. 12 shows a side view cross section taken through the center of rivet 21, "E" clip 23, thumb wheel 20 and bracket 25. It is pictorial and shows that the rivet is of the well known flush head type, having a chamfer around its head. The rivet, however, also has a groove adapted to receive the "E" clip. That clip cooperates with the chamfered rivet head to create a sandwich of bracket web 25, thumb wheel 20, and "E" clip 23. An alternative and equally useful embodiment is to weld the rivet in place, either with or without the chamfered head. In either embodiment it is important that the rivet not mar the side of the shotgun.

During videotaped tests of the invention, it has been discovered that the shotgun shell catcher described above has a particularly desireable shell trajectory when the curved wall 12 of the cage assembly is located no closer to the ejector port than the axial length of one shell casing ejected from the ejector port. The trajectory of the shell casing, as it ejects from the ejector port, rotates at least 170 degrees before coming to rest in the cage. It has been found that this controlled trajectory results in an unexpectedly large number of shells being able to fit into the cage, neatly lining themselves in parallel inside the cage, without any of the expended shell casings becoming wedged within the cage.

In an alternate preferred embodiment, a transparent plastic material 80 may be placed as shown in FIG. 1. It is locked in place by metal fingers 30 and others, not shown. The advantage of the transparent window is to allow viewing through the cage assembly while shooting, but also being shielded from smoke and vapor rising from the spent shell casings.

It is to be understood that the form of the invention herewith shown and described is to be taken as a preferred example of the same and that various changes in shape, size and arrangement of parts may be resorted to, without departing from the spirit of the invention or the scope of the subjoined claims.

I claim:

1. A receptacle for receiving expended shell casings from a firearm having a barrel and having an ejector port on one side of the firearm, comprising:

a. a cage having at least one opening, said opening aligned with the ejection port, and mounted to rotate about an axis substantially parallel to the barrel of the weapon, b. a bracket having a web attached to the firearm on the ejector side of the firearm, and c. toggle means comprising at least one spring connected between the bracket web and the cage, the spring is positioned so that the cage rotates to one of two rest positions, said first rest position aligns the cage opening with the ejector port and presses the cage against the firearm to define a closed pathway from the ejector port into the cage, and said second rest position has the the cage rotated away from the ejector port, thereby allowing access to the expended shell casings.

2. The shotgun shell catcher of claim 1 wherein the cage includes a curved wall located no closer to the ejector port than the axial length of one shell casing ejected from the ejector port, so that the trajectory of the shell casing, as it ejects from the ejector port, rotates at least 170 degrees before coming to rest in the cage.

3. A receptacle for receiving expended shell casings from a weapon having an ejection port, as said weapon is being discharged comprising:

a. a mounting bracket comprising two perpendicular webs, b. keyholes formed in one web of the mounting bracket, c. cam locking means mounted for rotation in a web of the mounting bracket, d. a hinge assembly e. a hinge pin within the hinge assembly, f. a mechanical stop to limit rotation about the hinge pin, g. a cage having only one opening, and mounted for rotation about the hinge pin, h. spring bias means attached between the mounting bracket and the cage, such that the cage tends to rock into a position pressing against the ejection port, or to pivot 90 degrees to a position which allows retrieval of the casings from the cage.

* * * * *